United States Patent [19]

Siebert et al.

[11] Patent Number: 4,793,258

[45] Date of Patent: Dec. 27, 1988

[54] TIME FUZE FOR UNPREDICTABLY-DETONATING SCATTER AMMUNITION

[75] Inventors: Rainer Siebert, Röthenbach; Erich Gerum, Nurnberg, both of Fed. Rep. of Germany

[73] Assignee: Diehl GmbH & Co., Nurnberg, Fed. Rep. of Germany

[21] Appl. No.: 123,180

[22] Filed: Nov. 20, 1987

[30] Foreign Application Priority Data

Dec. 16, 1986 [DE] Fed. Rep. of Germany ..... 3642862

[51] Int. Cl.[4] ..... F42B 3/00

[52] U.S. Cl. ..... 102/311; 102/215

[58] Field of Search ..... 102/311, 215, 216

[56] References Cited

U.S. PATENT DOCUMENTS 4,005,631 2/1977 Kaiser et al. ..... 89/6.5
4,149,467 4/1979 Fisher et al. ..... 102/207
4,577,561 3/1986 Perry ..... 102/215
4,664,013 5/1987 Wegner et al. ..... 89/6.5
4,709,615 12/1987 Field ..... 89/1.56

*Primary Examiner*—Peter A. Nelson
*Attorney, Agent, or Firm*—Scully, Scott, Murphy & Presser

[57] ABSTRACT

A time fuze or detonating device for unpredictably-detonating scatter ammunition, which is activatable through the intermediary of an electrical trigger signal. The time fuze or triggering device is equipped with a cyclical counter which, in dependence upon a time period which commences upon the deployment of the scatter ammunition, is supplied with counting pulses, and wherein upon the appearance of a switching information, there is counted further from an end-count position momentarily reached in the cyclical counter, into a pregiven triggering count position for the emission of the trigger signal.

5 Claims, 1 Drawing Sheet

TIME FUZE FOR UNPREDICTABLY-DETONATING SCATTER AMMUNITION

BACKGROUND OF THE INVENTION

1. Field of the Invention

The present invention relates to a time fuze or detonating device for unpredictably-detonating scatter ammunition, which is activatable through the intermediary of an electrical trigger signal.

2. Discussion of the Prior Art

In an article by Wolfgang Flume, entitled "MW-1-The Multi-Purpose Weapon System", Military Technology, Volume 2/1985, page 64, (middle of right-hand column on page 70), there is described the tactical significance of randomly or, in any event, quasi-randomly detonating scattered mines. Other possibilities for the utilization of such random-time fuzes or triggering devices are, for example, in aircraft runway bombs, whose boring charges should detonate upon impact; but whose explosive charges in contrast therewith, should only unpredictably detonate after a delay in time; or decoy elements which are deployed at sea, which are to be activated in different positions at non-predictable points in time for the irritation of a sonar position-finding installation; or self-destruct devices which are installed on bombs and projectiles, which because of any kind of reason, have triggered not in dependence upon an approach to or upon striking against the target.

SUMMARY OF THE INVENTION

Accordingly, it is an object of the present invention to provide such types of randomly-acting time fuzes or triggering devices which, with only a small requirement for circuitry, possess a high degree of operational reliability, and which, within about the period of time between the ejection and the striking of the ground by the scattered ammunition, deliver a broadest possible random distribution of the time periods up to the emitting of the respective trigger signal within a maximum predeterminable delay period dependent upon the technological capabilities of the circuitry.

The foregoing object is inventively attained in that the time fuze or triggering device of the type pursuant under consideration herein is equipped with a cyclical counter which, in dependence upon a time period which commences upon the deployment of the scatter ammunition, is supplied with counting pulses, and wherein upon the appearance of a switching information, there is counted further from an end-count position momentarily reached in the cyclical counter, into a pregiven triggering count position for the emission of the trigger signal.

The foregoing object is predicated on the recognition, that for a sufficiently wide random dispersion or distribution there is no need for the technological demands on circuitry for the generation of stochastic numbers (for example, referring to German Pat. No. 31 29 550) for the predetermination of final count conditions (upon the reaching of which there is emitted the trigger signal); but in contrast therewith, it is sufficient that, within an operationally required, not precisely fixed time period (such as the time interval between the ejection and the striking against the ground by the scatter ammunition), a counter possessing a limited count capacity is supplied with count pulses of such kind of high-frequencied pulse sequence, so as to quite frequently run through cyclically. As a result thereof, in the different kinds of, somewhat concurrently deployed articles of scatter ammunition there are obtained different final random count positions upon striking the ground; and these do not concentrate themselves into a certain sector of the count capacity, but because of the cyclical repetition of the count sequence, distribute over the entire breadth of the counting capacity. Hereby, in a good approximation, there is attained a statistic distribution of the final count positions through the ejected charge of submunitions, for which purpose there must be provided in each article of submunition only essentially a single cyclical counter with a pulse generator and a switching circuit for the start and termination of the counting sequence. Thus, when in the respective scatter ammunition, from the individual final count position thereof up to the emitting of a trigger signal upon the reaching (unitarily or differently pregiven) of a trigger count condition, there is further counted, at the individual articles of scatter ammunition, at quasi-statisically different time points, within a maximum time interval limited in circuitry through the counter and pulse frequency requisite, there will appear the individual ignition or trigger signals, in order to trigger the respective active charge. The maximum delay period commencing from the stop of the cyclically rapid running counter is also predeterminable through the subsequently effective count pulse frequency and the maximum available count volume.

Considered from the standpoint of circuit technology, it is particularly simple to implement such a time fuze or trigger device, when the function of the cyclical counter is combined with that of a counting pulse generator, in which two sequential inverting stages are connected as an R-C oscillator; for instance, as is described for a particular exemplary embodiment in the disclosure of German Published Patent Application No. 28 01 278.

For the course of the remaining time period from the randomly reached final count position up to the initiation of the trigger signal, during the continued use of the same counter, there can be switched over to a lower series frequency of the count pulses, and/or at the same or changed series frequency of the count pulses, to a higher counting capacity (for example, a further counter). Especially when there is afforded a minimum number of additional count steps after reaching of the final random count condition, counter outputs which have been actuated prior to the reaching of the triggering position for the trigger signal,, can also be employed for the initiation of program-controlled functions, such as arming measures contained in the individual scatter ammunition.

BRIEF DESCRIPTION OF THE DRAWINGS

Additional alternatives and modifications, as well as further features and advantages of the invention may now be readily ascertained from the following detailed description of generally schematic exemplary embodiments in the type of electrical circuit block diagrams, having reference to the accompanying drawings; in which.

DETAILED DESCRIPTION

Figure 1:
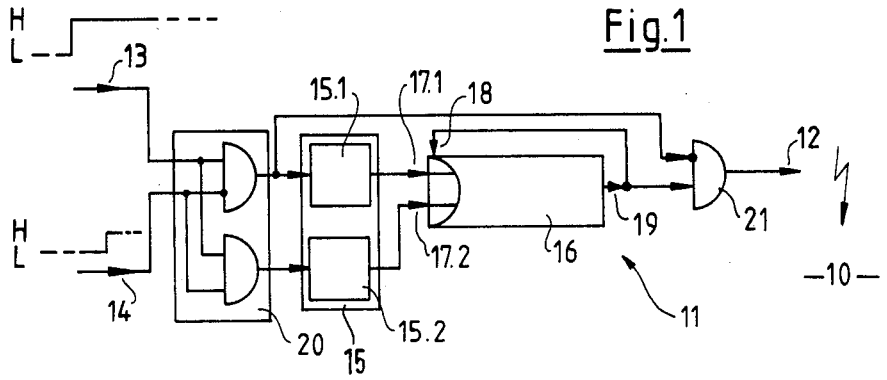
FIG. 1 illustrates a circuit for a quasi-stochastic electronic time fuze with a counter sequentially actuatable from differently designed pulse generators.

The time fuze or trigger device 11, which is represented in the drawing as an electrical circuit block diagram, is contemplated for application with scatter ammunition, which is ejected through the intermediary of a stationary deploying apparatus or, for example, an apparatus which can be carried along on an aircraft, and which should detonate on the ground within a predetermined time period at a non-predictable point in time; in essence, should not be triggered through a relative approach to a target object, inasmuch as the time fuze 11 delivers a trigger signal 12 to, for example, an electrical detonator (not shown).

For this purpose, the circuit of the time fuze 11 is placed into operation through the intermediary of a starting information 13, for example, in dependence upon leaving the deploying installation, for instance, through an assumption of the operating voltage from the on-board power supply of an aircraft or through the switching-in of a voltage source which is carried along by means of the acceleration of ejection or the release of a launch tube-sensor pin (not shown). As long as a switching information 14 (referred to hereinbelow) is not yet encountered, the starting information 13 provides for the operation of a pulse generator 15 for the relatively high-frequencied actuation of a cyclical counter 16. The latter is proportional with respect to the high counting pulse frequency 17.1, such that it frequently counts up to the end of its capacity, and then always begins a new counting cycle. In the drawing, this is represented in that a resetting pulse 18 is always again periodically generated in order to begin the next counting cycle; irrespective as to whether this resetting procedure takes place in binary counters without the need for such an external control pulse (namely internally, with the full exhaustion of the counting capacity).

When after a not exactly predeterminable time interval, there is encountered the switching information 14 commencing with the appearance of the starting information 13, then the counter 16 has thereby reached some kind of momentary counting position within its counting capacity.

The switching information 14, whose appearance interrupts the cyclical counting in this final count position, preferably appears in dependence upon a definite approach to a target; for example, upon the impact of the deployed ammunition against the ground and being somewhat triggered thereby through a switch (not shown) which is responsive to the landing shock or to the stationary weight. Inasmuch as a plurality of concurrently ejected articles of scatter ammunitions will only land in all instances on the ground at slightly different times due to environmental influences, such that the pulse generator 15 need not have its circuitry designed for the emission of a stabilized counting pulse frequency 17, an article of scatter ammunition which is ejected by a charge, after the landing on the ground, indicates practically a random distribution of the momentary final count condition of the individual counters 16, without requiring the need for any kind of circuitry for forcing a random distribution. As a result, on the ground, with the appearance of the switching information 14, the counter is thereby no longer further actuated from the momentary count position with the high-frequencied counting pulse sequence 17.1, but with a comparatively much slower pulse frequency 17.2, until the appearance of a pregiven count position, in the example of FIG. 1, the counter overrun signal 19. In accordance with the starting position of this slow further counting (in effect, in accordance with the final count position, which was reached with the high counting pulse frequency 17.1), beginning with the appearance of the switching information 14 it takes a differently long time, until there is first encountered the overrun signal 19 with the lower counting frequency 17.2; whereby the greatest time period can be pregiven through which the counting capacity of the counter 17 and the lower counting pulse sequence 17.2 by the circuitry; for example, a few hours or a few days.

Controlled through a switching circuit 20 for the switching over between a high-frequencied and a lower-frequencied pulse generator 15.1–15.2 in dependence upon the appearance of the switching information 14, there is released an output gate 21, in order to emit the trigger signal 12, as soon as the overrun signal 19 is encountered after the appearance of the switching information 14.

In contrast with the simplified representation in the drawing, there is no need to provide separate pulse generators 15.1 and 15.2 in order to provide, on the one hand, the quasi-randomly final count position within the counting capacity of the counter 16 upon the appearance of the switching information 14 and, on the other hand, to thereafter afford the slow further pulsing up to the emission of the trigger signal 12. Instead thereof, the informations 13, 14 can also be provided directly or through a switching circuit 20 to a pulse generator 15 for the internal switching over of its frequency-determined circuitry.

Figure 2:
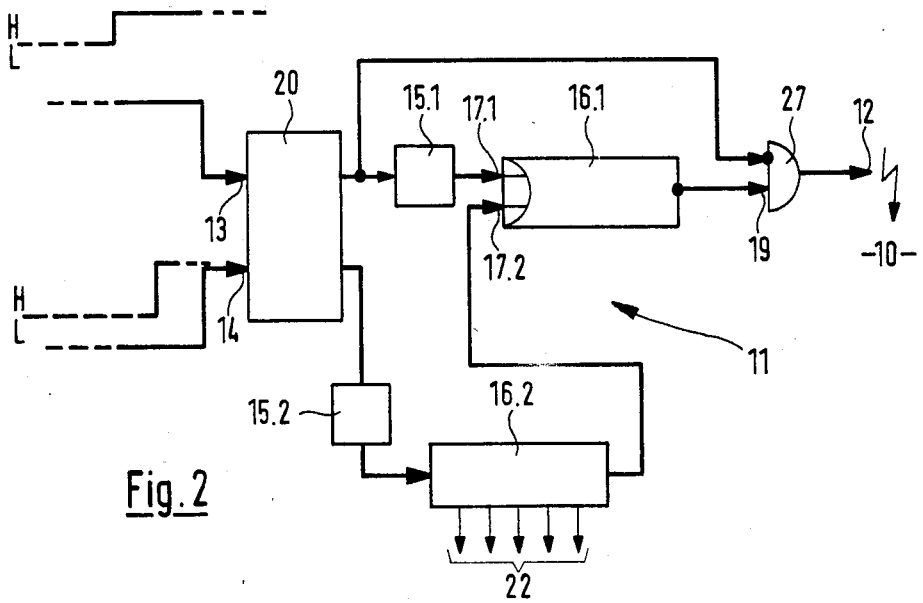
FIG. 2 illustrates a circuit block diagram modified with respect to that of FIG. 1, with counter switching and additional take off of time-control signals.

The circuit arrangement pursuant to FIG. 2 is predicated upon the same operational principle as that of FIG. 1, to the extent that a rapidly actuated cyclical counter 16 is counted through a number of times between the appearance of a starting information 13 and a switching information 14, so as to then be maintained in a random count position within entire available counting volume, and to thereby define the individual time period up to the initiation of a trigger signal 12. In order to simplify the exemplary embodiment of a circuit, there are again provided two pulse generators 15.1, 15.2 between which there is switched over the switching circuit 20 in dependence upon their sequential actuation. Beginning with the appearance of the switching information 14, the rapidly cyclically through-counting counter 16.1 is actuated with counting pulses 17.2 of a lower sequential pulse frequency, which are delivered by a now additional counter 16.2 which, in turn, (in the illustrated embodiment from the pulse generator 15.2) is counted through cyclically and will presently emit a counting pulse 17.2 at the end of its counting capacity. In accordance with the counting capacity of this additional counter 16.2, there is implemented the counting up of the first counter 16.1 from the stop position up to the initiation of the trigger signal 12 over a thereby extremely lengthy sizable time period; whereby, independently of the reaching of the final count position in the first counter 16.1 (also then when only one counting step should be lacking), there can previously be tapped off from the second counter 16.2 a number of timewise mutually definedly offset control signals 22. Ensured as a result thereof is that only after the appearance of the switching information 14, but already prior to the generation of the trigger signal 12, will there take place certain auxiliary functions, such as an arming through the electrical triggering of a pyrotechnic power element will take place. The counter 16.2 is initially set (by means of a resetting device not shown herein) into a starting position. When the stop position of the first counter 16.1 is distant by more than one counting step from the final count position, then the additionally further counter 16.2 connected ahead thereof will cyclically run through a number of times; however, in practice, this is not disturbing, inasmuch as the sequence of the control signals 22 will occur a number of times after each other; for example, since a one-time triggered pyrotechnic power element cannot be activated a second time, or a first-time actuation of an electronic switching circuit can be separated and blocked off on the control side through a sweep or flip-flop circuit. In any event, for the sequence of definite procedures between, for example, the impact of a submunition against the ground and the actuation of its warhead, there is obviated the need for the building in of an additional time control circuit and to start from a separately implemented detector circuit; such additional functions are operationally highly dependable and can be integrated without any particular demand on circuitry into the circuit of the random-time fuze.

What is claimed is:

1. A time fuze for unpredictably triggered scatter aummunition, said time fuze being initiated by an electrical trigger signal, comprising a cyclical counter which is supplied with counting pulses of high pulse frequency dependent upon a time period extending from the deployment of the scatter ammunition; and upon reaching a final count condition determined by the appearance of a switching information momentarily reached in said cyclical counter, said cyclical counter is counted further at a low pulse frequency into a pregiven triggering count condition for the emitting of the trigger signal.

2. A time fuze as claimed in claim 1, comprising a pulse generator of at least one R-C oscillator circuit of two sequential inverting steps of said cyclical counter.

3. A time fuze as claimed in claim 1, wherein a greater counting capacity is effective after the appearance of the switching information than prior to the appearance of the switching information.

4. A time fuze as claimed in claim 3, wherein the cyclical counter is interconnected with a further counter which is operative dependent upon the appearance of the switching information, for the emitting of lower-frequencied counting pulses to the first counter.

5. A time fuze as claimed in claim 4, wherein said switching information additionally provides control signals particularly for an arming programmed-sequence circuit to place said ammunition into condition for detonation upon the emitting of said trigger signal from said time fuze.

* * * * *